US005865427A

United States Patent [19]

Cowan

[11] Patent Number: 5,865,427

[45] Date of Patent: Feb. 2, 1999

[54] PLASTIC FENCING WITH REFLECTIVE TAPE

[75] Inventor: David A. Cowan, Cleveland, Ohio

[73] Assignee: Plastic Safety Systems, Inc., Cleveland, Ohio

[21] Appl. No.: 396,253

[22] Filed: Feb. 28, 1995

Related U.S. Application Data

[63] Continuation of Ser. No. 674,097, Mar. 25, 1991, abandoned.

[51] Int. Cl.[6] ..... E04H 17/14

[52] U.S. Cl. ..... 256/19; 256/1; 256/12.5; 156/292

[58] Field of Search ..... 256/19, 12.5, 24, 256/23, 25, 1, 13.1, 49, 45–50, 59, 66, DIG. 6; 404/6, 9; 40/610, 612; 156/292

[56] References Cited

U.S. PATENT DOCUMENTS

| | | | |
|---|---|---|---|
| 1,949,159 | 2/1934 | Glidden et al. | 428/255 X |
| 2,599,359 | 6/1952 | Banks et al. . | |
| 3,214,320 | 10/1965 | Lappala et al. | 428/255 X |
| 3,273,862 | 9/1966 | Miller | 256/24 X |
| 3,347,527 | 10/1967 | Andrews | 256/12.5 |
| 3,482,567 | 12/1969 | Franklin | 428/255 X |
| 3,913,889 | 10/1975 | Nugent et al. | 256/12.5 |
| 4,110,497 | 8/1978 | Hoel | 428/255 X |
| 4,186,912 | 2/1980 | Byrd . | |
| 4,339,114 | 7/1982 | Deike | 256/12.5 |
| 4,526,405 | 7/1985 | Hattemer . | |
| 4,605,204 | 8/1986 | Schmanski et al. | 256/19 |
| 4,756,946 | 7/1988 | Mercer | 428/255 X |

FOREIGN PATENT DOCUMENTS

| | | | |
|---|---|---|---|
| 2406695 | 6/1979 | France | 256/24 |
| 2560243 | 8/1985 | France | 256/13.1 |
| 2843639 | 4/1980 | Germany . | |
| 1450390 | 9/1976 | United Kingdom | 256/13.1 |

*Primary Examiner*—Harry C. Kim
*Attorney, Agent, or Firm*—Renner, Otto, Boisselle & Sklar, P.L.L.

[57] ABSTRACT

Plastic fencing has a plurality of openings therein and one or more strips of reflective tape applied to one or both sides of the fencing to make the fencing more visible under poor lighting conditions as when used as a visual warning barrier around construction sites and the like. To secure the reflective tape to the fencing, the reflective tape is adhered to one side of the fencing in overlying relation to some of the openings therein, and to a plastic backing applied to the opposite side in line with the reflective tape through the openings in the fencing.

7 Claims, 1 Drawing Sheet

PLASTIC FENCING WITH REFLECTIVE TAPE

This is a continuation of application Ser. No. 07/674,097 filed on Mar. 25, 1991, now abandoned.

BACKGROUND OF THE INVENTION

This invention relates generally, as indicated, to plastic fencing having reflective tape applied thereto to make the fencing more visible at night or under other conditions of poor visibility when used as a visual warning barrier around construction sites and the like.

It is generally known to apply glass beads to plastic fencing to make the fencing more visible under poor lighting conditions. One of the problems with using glass beads is that they must be applied in a secondary operation making the fencing more costly. Also, when the fencing is cleaned of mud and the like in the field, the cleaning operation oftentimes strips the glue and the glass beads off of the fencing.

Reflective tape has also been applied to plastic fencing to make the fencing more visible under poor lighting conditions. However, keeping the tape adhered to the fencing has been a major problem. Fencing with fewer and smaller holes has been tried to provide increased surface area for the reflective tape to better adhere. It is known, for example, to eliminate entire rows of holes in the plastic fencing to provide more surface area for the tape to adhere to. However, this requires the use of additional plastic material which adds to the cost of the fencing. Also, the increased surface area substantially increases the wind resistance of the fencing, thus rendering the fencing less stable and more easily blown by the wind. A further problem encountered is that when reflective tape with a pressure sensitive adhesive backing is applied to plastic fencing, the reflective tape has a tendency to wrinkle, especially when the fencing is rolled up for storage and transported to a job site and unrolled for reuse.

SUMMARY OF THE INVENTION

With the foregoing in mind, it is a principal object of this invention to provide a unique and relatively inexpensive way of more securely adhering reflective tape to plastic fencing.

In accordance with one aspect of the present invention, one or more strips of reflective tape having a self adhesive backing is applied to one side of the fencing with the reflective tape overlying a series of holes in the fencing and a backing strip is applied to the opposite side in line with the reflective tape, thus sandwiching a portion of the fencing between the tape and backing strip so that the tape adheres both to the fencing and to the backing strip exposed to the tape through a plurality of holes in the fencing.

In accordance with another aspect of the invention, the reflective tape is a high intensity reflective tape made of a suitable plastic such as a vinyl based material, and the backing strip is similarly made of a suitable plastic such as polyethylene.

In accordance with yet another aspect of the invention, the backing strip for the reflective tape is desirably somewhat wider than the tape itself to ensure that none of the adhesive backing on the reflective tape is left exposed to stick to itself or to other objects when the fencing is rolled up for storage and subsequently unrolled for reuse. Alternatively, the self adhesive backing may be applied to the backing strip rather than to the reflective tape, in which event the reflective tape is desirably somewhat wider than the backing strip for essentially the same reasons.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
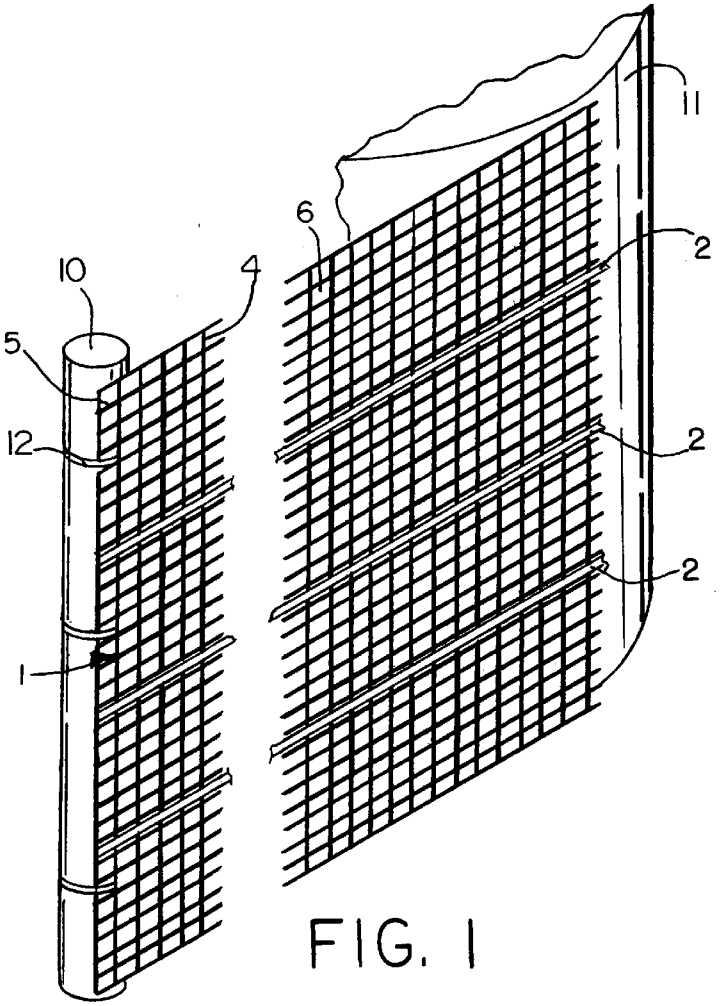
FIG. 1 is a schematic perspective view of a length of plastic fencing with reflective tape adhered thereto in accordance with this invention shown supported in conventional manner.

Referring now in detail to the drawings, and initially to FIG. 1, there is shown one type of plastic fencing 1 to which one or more strips of high reflective or high intensity tape 2 is applied in accordance with this invention. The fencing 1 may be of conventional type such as used as a warning barrier around construction sites and the like which is made of a suitable plastic material such as high density polypropylene or polyethylene. Such fencing 1 may for example be about 13 mils thick and consists of an open lattice-like structure of cross is members 4, 5 defining openings or holes 6 therebetween. Normally such fencing is made either by biaxially orienting the fencing or by straight extrusion using counter-rotating dies.

The holes 6 in the plastic fencing 1 may be of different shapes, including triangular, round, oval, or square, to name a few. The larger and greater the number of the openings 6, the less material required to make the fencing, making it less costly to manufacture. However, in some cases it may be desirable to reduce the number and/or size of the openings to increase the surface area of the fencing, for instance, for use as a snow fence, or as a warning barrier, in which event the fencing has a larger mass and is more easily seen. The present invention contemplates the use of the less costly, larger number/size opening plastic fencing while still allowing it to be easily seen by applying one or more strips of a highly reflective or high intensity tape 2 to one or both sides of the fencing as described hereafter. The reflective tape 2 may, for example, be of the type manufactured by 3M Company, which is made of multilayers of a vinyl based material, with a water resistant pressure sensitive adhesive 8 on the back side of the tape.

To secure the reflective tape 2 to the fencing 1, the reflective tape 2 is adhered to one side of the fencing by the adhesive backing 8. In addition, however, a backing strip 9 is pressed up against the side of the fencing opposite the reflective tape 2 and in line therewith, thus sandwiching that portion of the fencing between the tape 2 and backing strip 9 with the tape adhered to the fencing cross members 4 and/or 5 and the backing strip through a plurality of openings 6 in the fencing.

Preferably the backing strip 9 is made of a suitable plastic such as polyethylene which may, for example, be approximately 3 mils thick. The plastic material used to make the backing strip 9 may either be clear or of different colors as desired.

Figure 2:
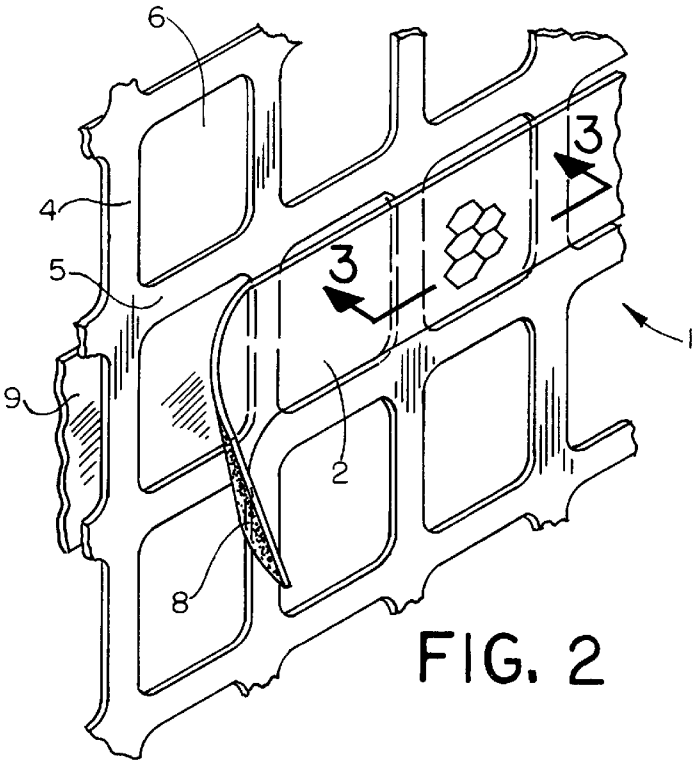
FIG. 2 is a fragmentary enlarged perspective view of a portion of the plastic fencing of FIG. 1 showing the reflective tape being applied thereto in accordance with this invention.
Figure 3:
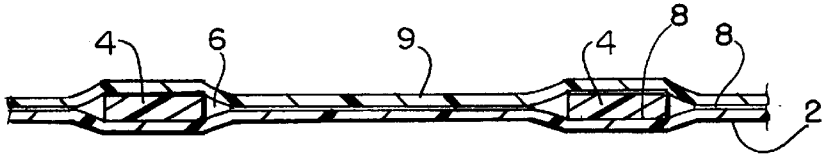
FIG. 3 is an enlarged fragmentary longitudinal section through the plastic fencing and reflective tape of FIG. 2, taken substantially along the plane of the line 3—3 thereof.

Both the backing strip 9 and reflective tape 2 are elongate, and where the pressure sensitive adhesive 8 is on one side of the reflective tape 2, the backing strip 9 is desirably somewhat wider than the reflective tape itself as schematically shown in FIG. 2. This has the advantage that when the tape 2 and backing strip 9 are applied to opposite sides of the fencing 1 in alignment with each other, none of the adhesive backing 9 on the reflective tape 2 will be left exposed through any of the openings 6 to stick to itself or to other objects, which is especially important if the fencing is rolled up for storage and subsequently unrolled for reuse. Of course, it should be understood that the adhesive material could be applied to the backing strip 9 instead of to the reflective tape 2, in which event the reflective tape would desirably be made somewhat wider than the backing strip for the same reasons.

Using a separate backing strip 9 to help secure the reflective tape 2 in place has the further advantage that printing may be applied to the back side of the backing strip 9 before the backing strip 9 is applied to the plastic fencing 1, for example to identify the owner and/or intended use/location of the particular fencing.

It is contemplated that three strips of reflective tape 2 be applied to one or both sides of a 4' high plastic fencing 1 as schematically shown in FIG. 1. Also, it is contemplated that the plastic fencing 1 be anchored by attaching the fencing to fiberglass or steel poles 10 using coated wire ties 12 or placed around barrels 11 as further schematically shown in FIG. 1.

The fencing 1 is typically rolled up after use at one site for storage and subsequent use at another site as part of an overall reusable safety fencing system. Without the backing strip 9, when the fencing is rolled up, the reflective tape 2 may stick to itself and wrinkle when subsequently unrolled. The backing strip 9 substantially prevents that from happening, thus protecting the reflective tape 2, which is important from an economic standpoint because of the cost involved if the reflective tape has to be replaced.

In the fencing 1 illustrated herein, the cross members 4, 5 are desirably spaced apart from each other an appreciable distance to define for example approximately $1\frac{5}{16}$"×$1\frac{13}{16}$" openings 6 therein. The reflective tape 2 may for example be approximately 1" wide and the backing strip 9 approximately $1\frac{5}{8}$" wide. Where the reflective tape 2 has a width between edges less than the height of the openings 6 in the plastic fencing 1, the reflective tape may be positioned relative to the openings such that the edges of the reflective tape are within the height of the opening, and substantially the entire surface area of the reflective tape overlying the openings including the edges of the reflective tape are adhered to the backing strip 9 through the openings as schematically shown in FIG. 2. In FIGS. 1 and 2 the strips of tape 2 and aligned backing strips 9 are shown extending substantially horizontally across one side of the fencing 1, adhered to at least the cross members 4 which are shown as being substantially vertical when the fencing is in use. However, it will be apparent that the cross members 4, 5 may extend in different directions if desired. Likewise, it will be apparent that the aligned strips of reflective tape 2 and associated backing strips 9 may be applied to the fencing at different angles from vertical to horizontal and still provide a highly visible fencing structure.

As previously indicated, the reflective tape 2 and backing strip 9 are preferably made of vinyl and polyethylene, respectively. However, it will be apparent that other water resistant materials could be used for the reflective tape and backing strip, keeping in mind that it is desirable to substantially completely cover the adhesive side of the reflective tape with the backing strip or vice versa to thereby protect it from the elements, making it more easily washable, and reducing the possibility of the tape sticking to itself or wrinkling when the fencing is rolled up for storage and subsequently unrolled for reuse. Securing the reflective tape to the protective backing strip through the openings in the fencing has been found effective to accomplish these ends.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A plastic fencing structure for use as a warning barrier around construction sites, said plastic fencing structure comprising plastic fencing having a plurality of openings therein, plastic reflective tape strip means for making said fencing structure more visible under poor lighting conditions engaging a portion of one side of said plastic fencing and overlying a plurality of said openings, plastic backing strip means engaging a portion of another side of said plastic fencing in substantial alignment with said reflective tape strip means, said reflective tape strip means having a water resistant pressure sensitive adhesive backing extending the full length of said reflective tape strip means on a side facing said plastic fencing for adhering said reflective tape strip means to said backing strip means through said openings and to said portion of said plastic fencing sandwiched between said reflective strip means and said backing strip means, said reflective tape strip means having a width between edges less than a height of said openings in said plastic fencing over which said reflective tape strip means lies, said reflective tape strip means being positioned relative to said openings such that the edges of said reflective tape strip means are within the height of said openings, substantially the entire surface area of said reflective tape strip means overlying said openings including the edges of said reflective tape strip means being adhered to said backing strip means through said openings.

2. The fencing structure of claim 1 wherein said backing strip means has a width that is greater than the width of said reflective tape strip means, said backing strip means having edges that extend outwardly beyond the edges of said reflective tape strip means within said openings whereby said backing strip means completely covers said pressure sensitive adhesive backing of said reflective tape strip means within said openings.

3. The fencing structure of claim 2 wherein the width of said backing strip means is greater than the height of said openings in said plastic fencing over which said reflective tape strip means lies, said backing strip means being positioned relative to said openings such that the edges of said backing strip means extend beyond the height of said openings.

4. The fencing structure of claim 3 wherein a plurality of said reflective tape strip means and aligned backing strip means are applied to opposite sides of said plastic fencing in spaced apart relation from each other in overlying relation to a plurality of said openings in said plastic fencing with substantially the entire surface area of said reflective tape strip means overlying said openings including the edges of said reflective tape strip means being adhered to said backing strip means through said openings.

5. The fencing structure of claim 2 wherein the width of said reflective tape strip means is approximately 1 inch, and the width of said backing strip means is approximately 1⅝ inches.

6. The fencing structure of claim 5 wherein the height of said openings in said plastic fencing over which said reflective tape strip means lies is greater than 1 inch and less than 1⅝ inches.

7. The fencing structure of claim 5 wherein said openings are approximately 1 5/16 inches high by 1 13/16 inches wide.

* * * * *